United States Patent [19]

Kelley

[11] Patent Number: 4,948,205

[45] Date of Patent: Aug. 14, 1990

[54] DESK WITH CONCEALED WIRE STORAGE

[75] Inventor: James O. Kelley, Spring Lake, Mich.

[73] Assignee: Sligh Furniture Co., Holland, Mich.

[21] Appl. No.: 320,701

[22] Filed: Mar. 8, 1989

[51] Int. Cl.[5] ..... A47B 17/00

[52] U.S. Cl. ..... 312/196; 312/223; 108/50

[58] Field of Search ..... 108/143, 50; 312/208, 312/196, 223

[56] References Cited

U.S. PATENT DOCUMENTS

| | | | |
|---|---|---|---|
| 1,512,937 | 10/1924 | Knaster | 312/196 X |
| 2,850,341 | 9/1958 | Spinner | 108/50 X |
| 3,883,202 | 5/1975 | Ronig | 312/223 |
| 4,372,629 | 2/1983 | Propst et al. | 312/196 X |
| 4,561,619 | 12/1985 | Robilland et al. | 108/143 |
| 4,681,043 | 7/1987 | Sticht | 312/196 X |

*Primary Examiner*—Peter A. Aschenbrenner

*Attorney, Agent, or Firm*—Waters, Morse & Harrington

[57] ABSTRACT

A desk and a half-wall are combined to make the space within the wall available for the storage of wires and equipment associated with devices in use on or adjacent the desk. The half-wall extends above the desk top, and has a slot traversed by the wires leading out to the devices. Brackets that also traverse the slot can be used to support the devices well above the desk surface. The inner panels forming the half-wall are adapted to support shelves under the desk.

19 Claims, 6 Drawing Sheets

DESK WITH CONCEALED WIRE STORAGE

BACKGROUND OF THE INVENTION

The increasing amount of electronic and mechanical equipment used in the office work area presents a problem to the designer of high-quality executive and secretarial furniture employing traditional designs, particularly wood furniture. The maintenance of a clean, classical appearance is a requirement, but is made difficult by the need to accommodate the endless mass of wires, conduits, and other support systems for the communication and computer devices the executive or his secretary must have available at all times. One approach to this problem has been to provide a covered trough in the top of a desk to receive this clutter of items. U.S. Pat. No. 3,883,202 discloses desk and storage units mounted on a metal rail. The storage containers are mounted on a rear side of the rail, and desk work surfaces are mounted at different heights on the front of the rail. When a lower height work surface is employed, the rail protrudes above the height of the work surface along the rear edge of the desk surface. The rail provides a wire storage receptacle with a front-facing slot to admit wires leading to devices in use on the desk. Devices of this nature normally take up desk space, are not compatible with traditional designs, and interfere with the movement and organization of the papers and reference material confronting the executive or his secretary. The present invention has been developed to provide a solution to these problems in a structure that can preserve the appearance of clean, classical design.

SUMMARY OF THE INVENTION

A desk is combined with an integral half-wall structure forming the rear panel and/or one or more side panels of the desk, the wall extending above the level of the desk top and providing space within the wall as a storage receptacle for wires and equipment used on or adjacent the desk. A slot in the wall structure above the desk top is traversed by the wires at selected and movable positions. The top of the wall structure is hinged for the installation access, and defines the top of the slot when the cover is closed. The inner panels forming the wall structure are adapted to support shelves under the desk. Accessory brackets traverse the slots to support devices above the desk, leaving work clearance below them while placing the devices in the best position for use. The accessory brackets connect to a coupling terminal within the half-wall structure that extends opposite the slot to provide lateral adjustability.

These and other features of the present invention are described in detail below in connection with preferred embodiments of the present invention.

DESCRIPTION OF THE PREFERRED EMBODIMENTS

Figure 1:
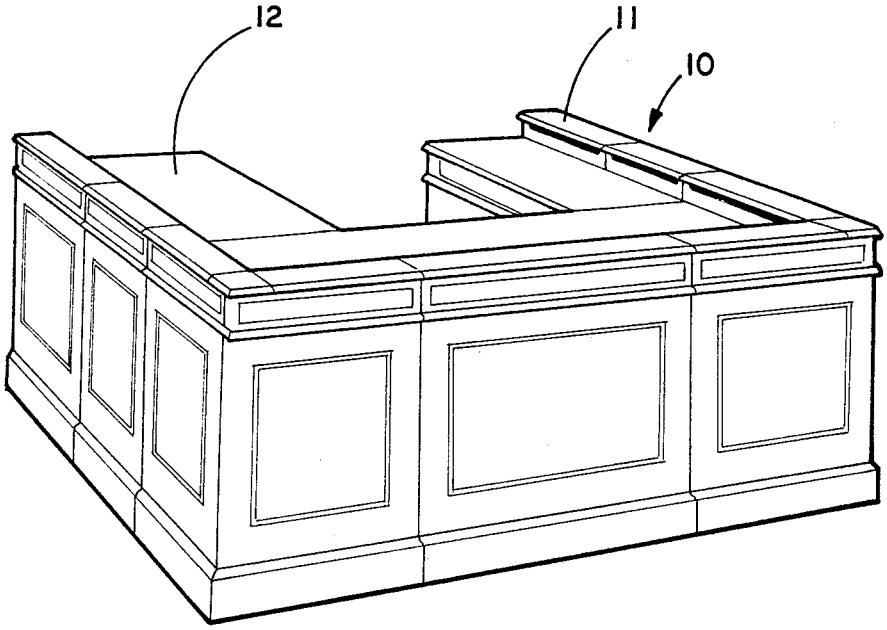
FIG. 1 is a perspective view of a desk in a U-shaped configuration, with the half-wall structure extending above the desk around three sides.
Figure 3:
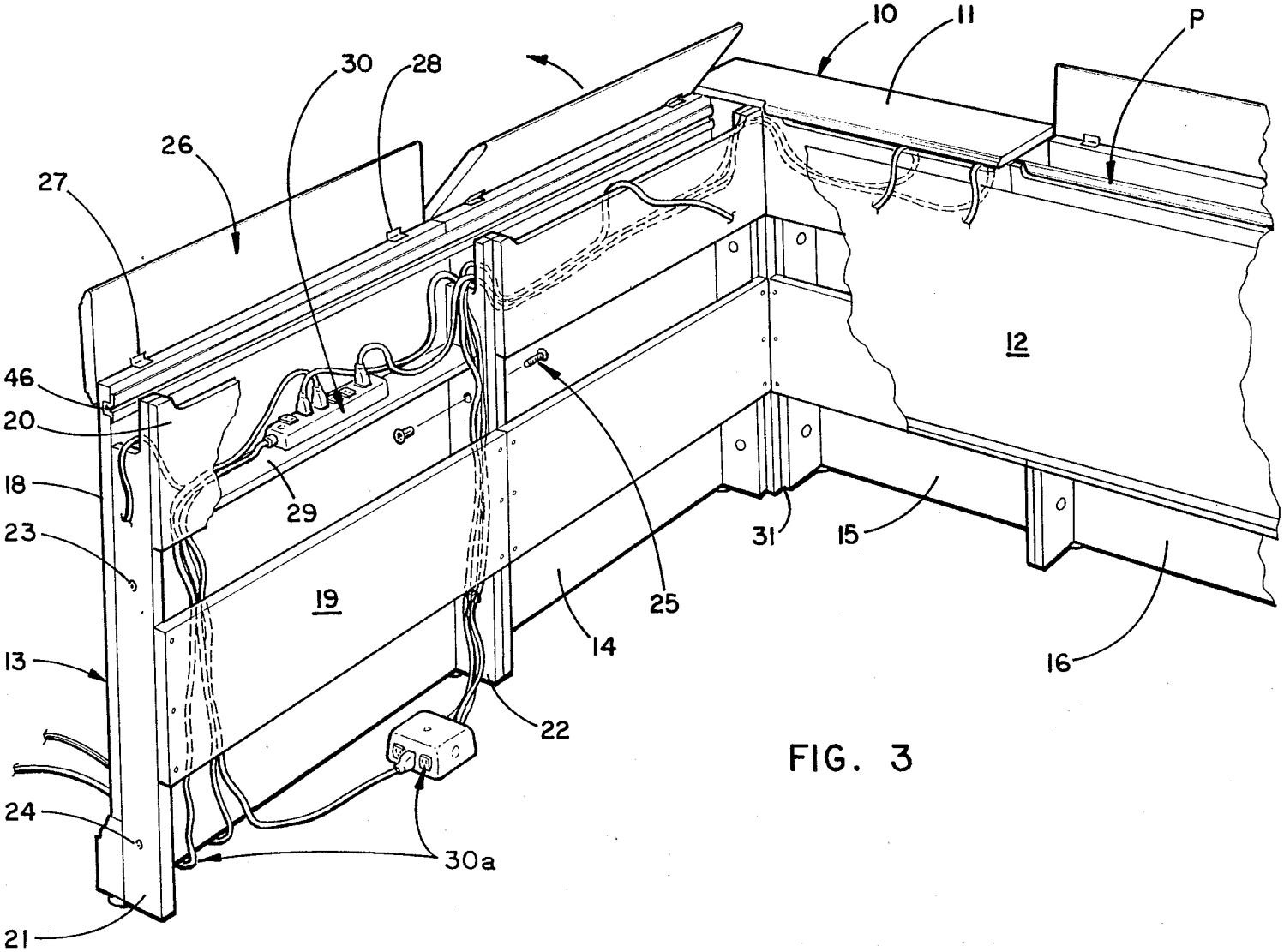
FIG. 3 is a fragmentary perspective view of a group of four half-wall modules connected together around part of the periphery of a desk surface.

Referring to FIG. 1, a wood desk of the traditional design generally indicated at 10 has a half-wall structure 11 extending above the work surface 12 around all three sides of the desk. The structure providing the features of this desk are best shown in FIG. 3. The half-wall modules 13–16 are shown apart from the remainder of the desk structure, with the exception of the panel forming the top surface 12. The modules are similar in construction, and the details described in connection with one of them are essentially the same for the rest. The outer panels 18 are separated from the inner panels 19 and 20 by vertical spacer beams 21 and 22. The abutting spacer beams of adjacent modules are provided with aligned holes as shown at 23 and 24 to receive interengageable fasteners as shown at 25. The cover 26 is hinged to the outer panel 18 as shown at 27 and 28 to provide access to the space between the panels. The floor 29 defines the bottom of the space forming a receptacle for the equipment generally indicated at 30 associated with the various devices arranged on or near the desk top 12. At the right angle junctions of sections of the half-wall structure, it is preferable to include a hollow corner post 31 to receive the module fastenings, and the covers 26 may be interrelated as shown in FIG. 3 at this junction.

Figures 4, 5:
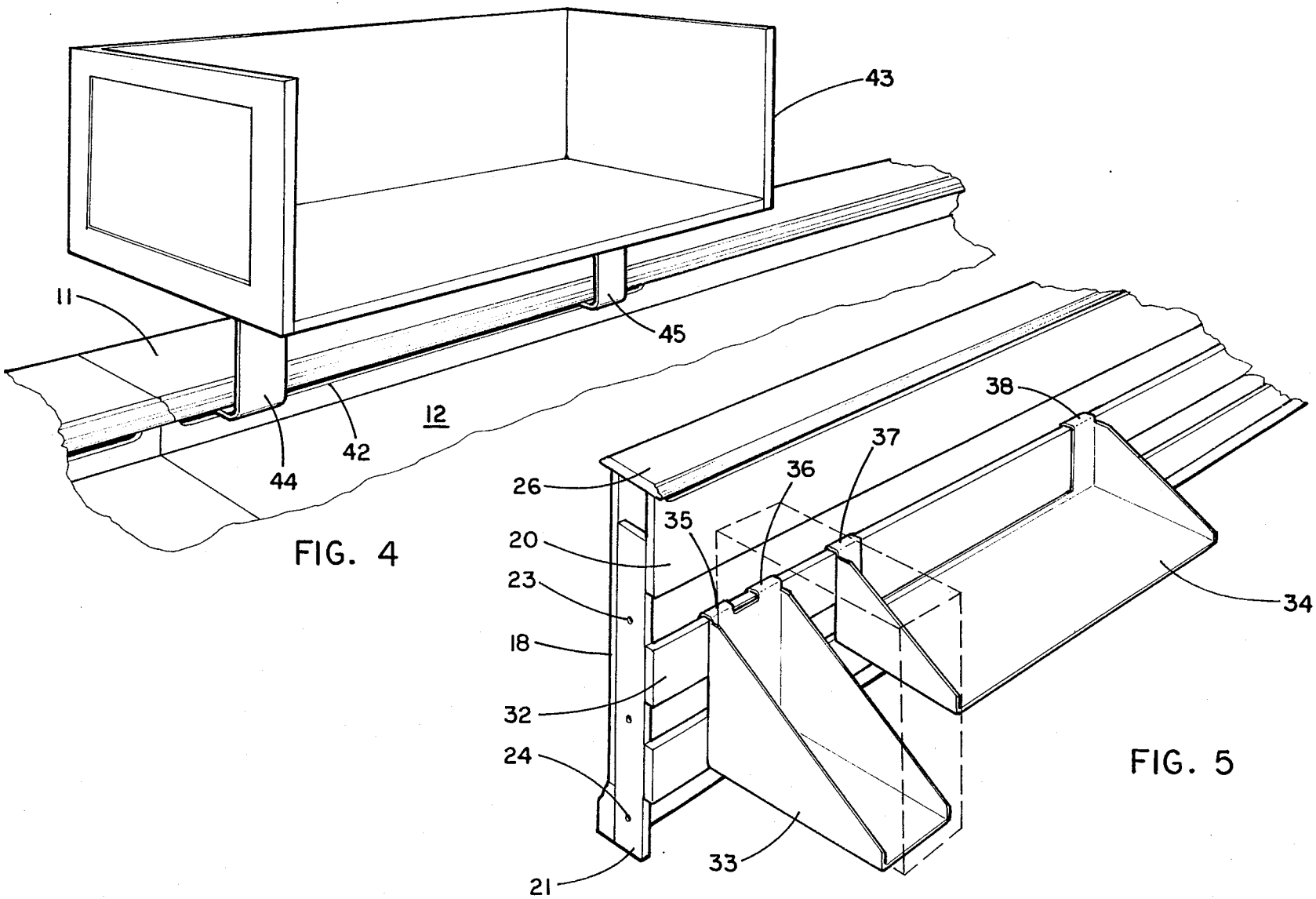
FIG. 4 is a fragmentary perspective view showing a book shelf as an accessory installed on a desk embodying this invention.
FIG. 5 is a fragmentary perspective view showing the installation shelves underneath the desk surface, supported by the half-wall structure.

Referring to FIG. 5, the inner panel 32 is shown vertically separated from the upper inner panel 20, permitting the shelf brackets 33 and 34 to be hooked over the upper edge of the panel 32 as shown at 35–38. These shelf brackets are useful for the storage of support equipment that may be associated with the computers and communication devices positioned on or near the top of the desk. Conduits from such support equipment may be led through appropriate holes in the floor 29, if desired. Alternatively, the floor 29 may be terminated short of the vertical beams 21 and 22, as shown in FIG. 3. Wires from electrical outlets on the floor below the desk, as indicated at **30*a*, in FIG. 3, may also be led up into the wall structure at these points. The interior space may be partitioned as shown at P in FIG. 3 to separate the various items. It should also be noted that the tops of the beams 21 and 22 are also terminated or recessed below the covers 26** to provide for the running continuity of space in the successive modules.

Figure 2:
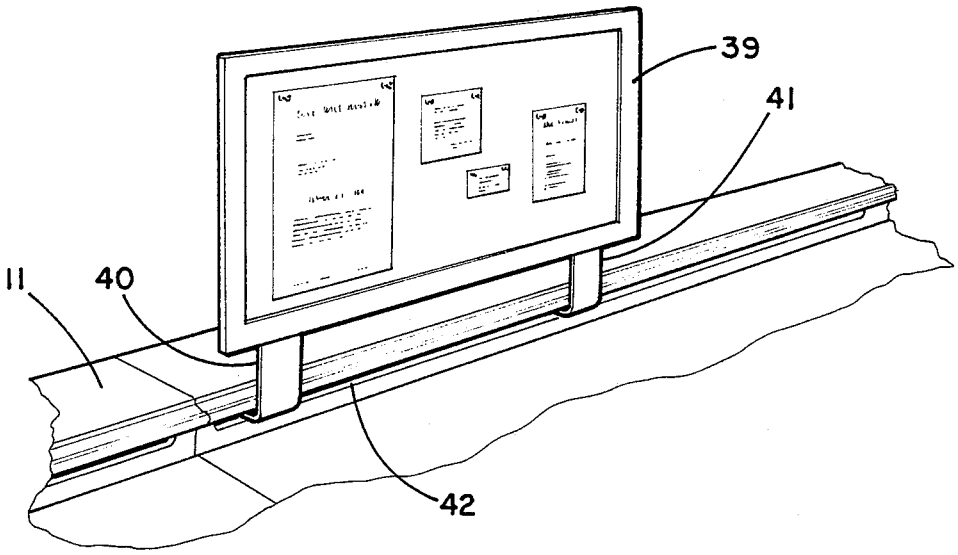
FIG. 2 is a fragmentary perspective view showing a tack board as an accessory installation in conjunction with the desk.
Figures 6, 7, 8:
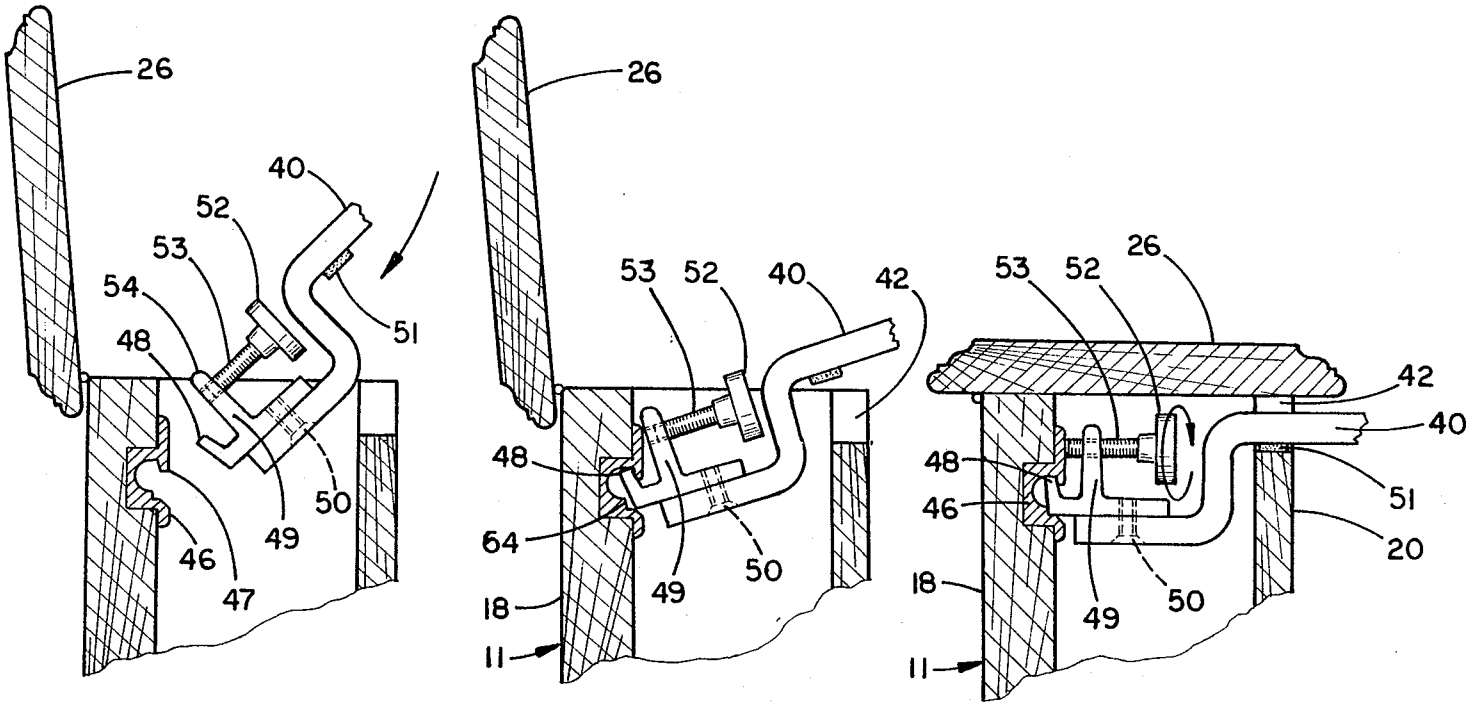
FIGS. 6, 7, and 8 show successive views in section, illustrating the installation and securing of a bracket for supporting a desk accessory.

FIGS. 2 and 4 illustrate examples of accessory devices that can be mounted on the half-wall structure without interfering with the space on the desk top. In FIG. 2, a tack board 39 is supported by the brackets 40 and 41 traversing the slot 42 in the upper portion of the half-wall structure 11. In FIG. 4, the book shelf 43 is shown supported by the brackets 44 and 45 traversing the same slot. The terminal system shown in FIGS. 6, 7, and 8 extends along opposite the slot, and thus provides for a considerable degree of lateral adjustability of the accessories as may be required. The terminal member is an extrusion 46 having a hook portion 47 receiving the mating hook 48 of the coupling attachment 49 secured to the bracket 40 by screws as indicated at 50. The bracket arm 40 and its attachment 49 are first inserted into the space between the inner and outer wall panels, as shown in FIG. 6. Since the top of the slot 42 is defined by the cover 26 when the cover is closed, the opening of the cover opens the slot for the admission of the accessory bracket arm 40. After the hooks 47 and 48 are interengaged as shown in FIG. 7, the bracket arm is pivoted downwardly to bring the components into the FIG. 8 position. An abrasion reducing pad 51 can be adhesively (or otherwise) secured to the underside of the bracket arm 40 at a position at which it will rest upon the top edge of the inner panel 20 defining the lower extremity of the slot 42. Before closing the cover 26, a knob 52 controlling the bolt 53 is rotated so that it advances in its threaded engagement with the flange 54 of the attachment 49, and forms an abutment that can be tightened against the upper portion of the extrusion 46 to prevent an upward rotation of the assembly that might disengage the hooks forming the terminal connection. The final tightening of the knob 52 should take place after the lower part of the hook 48 interengages with the offset 64 of the extrusion 46 so that the position of the attachment is securely determined. The tightening action forces these portions of the components into solid engagement, and prevents both radial and tangential displacement of the coupling with respect to the hook of the terminal and prevents the bracket from sliding sideways in the slot.

Figure 9:
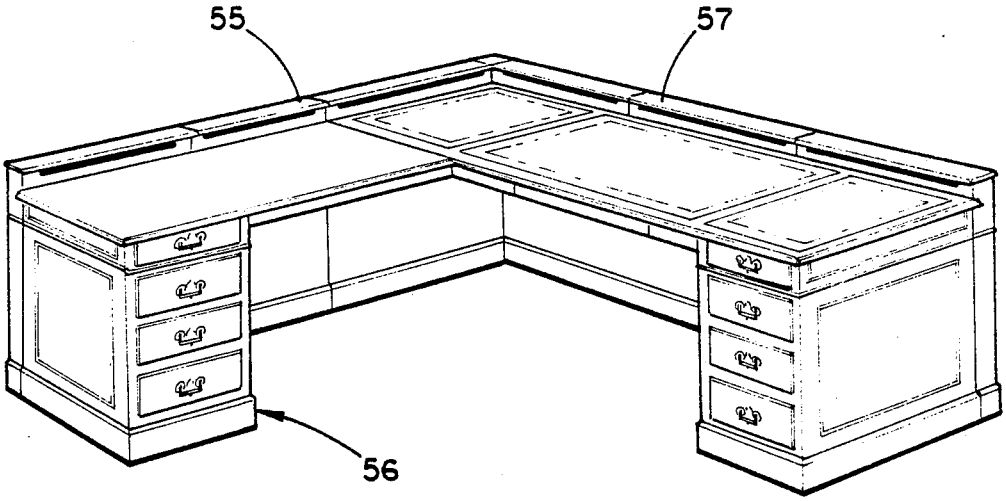
FIG. 9 the invention incorporated in an L-shaped desk, along both sides.
Figure 11:
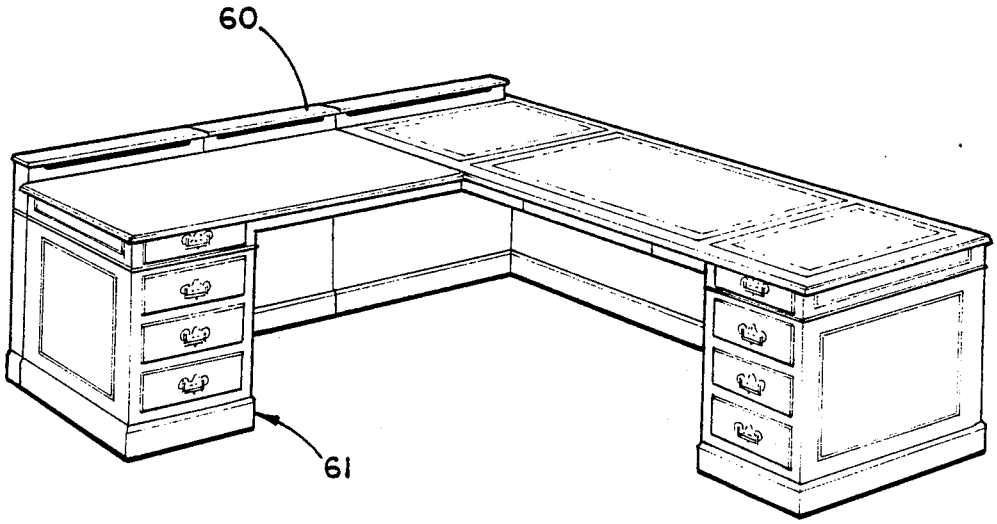
FIG. 11 shows an L-shaped desk, with the invention incorporated along one side only.
Figure 10:
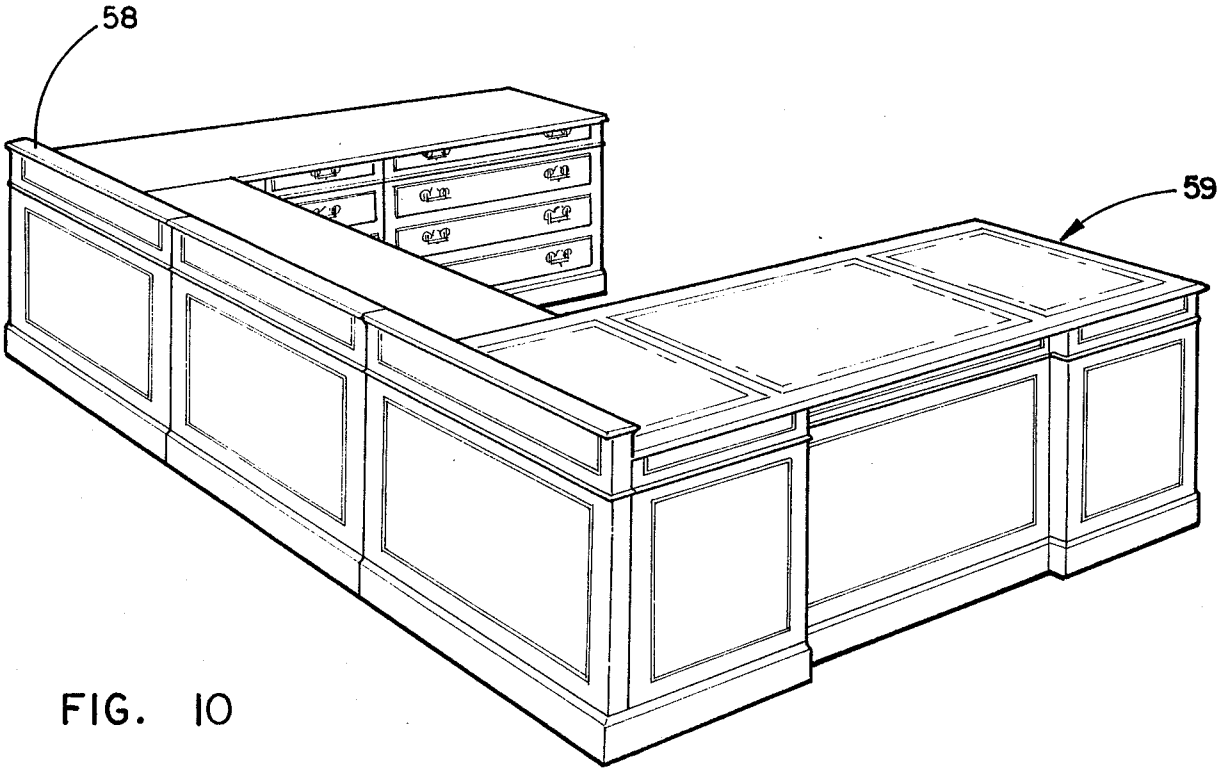
FIG. 10 shows a U-shaped desk, with the invention incorporated the closed side.

FIGS. 9, 10, 11 show the invention incorporated in various desk configurations. In FIG. 9, the wall structure 55 extends along one side of an L-shaped desk 56, and the wall structure 57 along the other side. In FIG. 10, the wall structure 58 extends along the closed side of the U-shaped desk 59. In FIG. 11, the wall structure 60 extends along one side of the L-shaped desk 61. These views illustrate the adaptability of the structure to the various common forms of executive desks.

The embodiments of the present invention in which an exclusive property or priviledge is claimed are defined as follows:

1. An article of furniture having a top providing a work surface, wherein the improvement comprises;

a half-wall structure extending above said work surface and defined by horizontally spaced parallel inner and outer panels forming at least one side of said article of furniture, and providing a storage space between said panels;

a cover movably secured to said half-wall structure and forming a top closure for said storage space, said inner panel having a horizontal access slot between said work surface and said cover;

accessory bracket means for supporting desk accessories above the surface of the desk, the accessory bracket means being mounted in the storage receptacle and extending through the slot to support the desk accessories; and terminal means for supporting the accessory bracket means by engagement with coupling means on the accessory bracket means, the terminal means being secured to the interior of said half-wall structure opposite said slot, the terminal means having a hook portion opening downwardly, and said coupling means having a mating hook portion engageable with said terminal hook portion in an upwardly rotated position of said coupling means hook portion, said coupling means also having an adjustable abutment extendable after engagement of said terminal and mating hook portions to prevent back-rotation of said bracket means toward a disengaging position.

2. An article of furniture as defined in claim 1, wherein said terminal means additionally has a fixed abutment engageable by said coupling means on the opposite side of said hook portion from said adjustable abutment means.

3. An article of furniture having a top providing a work surface, wherein the improvement comprises:

a half-wall structure extending above said work surface and defined by horizontally spaced parallel inner and outer panels forming at least one side of said article of furniture, and providing a storage space between said panels;

a cover movably secured to said half-wall structure and forming a top closure for said storage space, said inner panel having a horizontal access slot between said work surface and said cover;

accessory bracket means for supporting desk accessories above the surface of the desk, the accessory bracket means being mounted in the storage receptacle and extending through the slot to support the desk accessories; and terminal means for supporting the accessory bracket means by engagement with coupling means on the accessory bracket means, the terminal means being secured to the interior of said half-wall structure opposite said slot, said accessory bracket means being at least partially supported by the portion of said half-wall structure defining the bottom of said slot.

4. An article of furniture as defined in claim 3, wherein said terminal means is a continuous member extending opposite the full length of said slot.

5. A combination free standing desk and half wall structure, the half wall forming at least one outer side of the desk, the half wall comprising outer and inner vertical panels spaced apart by spacers positioned between the panels, the outer panel forming the outer side of the desk and wall structure and serving to identify a half wall boundary of a corridor, the inner panel forming the inner side of the half wall, the desk comprising a generally horizontal desk top attached at one edge to the half wall and supported thereby, the inner and outer panels of the half wall extending upwardly from the desk top to upper edges forming an upper end of the half wall positioned above the desk top, the upper end being covered by an openable top, the inner panel having an inwardly facing longitudinal slot therein adjacent the top at an openable portion thereof, the half wall having a storage receptacle between the outer and inner panels that is accessible through the top and the slot, the receptacle extending the length of the half wall structure such that electrical wiring can be conveyed the length of the half wall structure through the storage receptacle, the desk and half wall structure having the appearance of a desk abutting a half wall, with electrical wiring being easily accessible to the desk top through the inwardly facing slot and openable top in the half wall structure.

6. An article of furniture as defined in claim 5, wherein the cover is pivotally mounted on the top of the outer panel, and the top of said slot is defined by said cover in the closed position thereof.

7. A combination free standing desk and half wall structure according to claim 5, wherein the inner panel of the half wall extends downwardly from its upper edge at least to the desk top, the half wall further including a lower inner panel running longitudinally along the half wall structure at a point below the desk top, the lower inner panel being spaced from the outer panel by spacers and attached thereto in a fixed position, the lower inner panel having an upper edge, an article supporting shelf being removably mounted and laterally slidable on the upper edge of the lower panel by means of a hook that extends from the shelf over the top of the lower panel.

8. A combination free standing desk and half wall structure according to claim 5, wherein the storage receptacle has a floor recessed below the level of the desk top, at least one multi-socket electrical outlet being positioned on the floor of the storage receptacle, wiring for electrically operated desk-mounted products exiting the wiring receptacle by the slot, the wiring being removable by opening the top of the half wall, the top being pivotally mounted on the outer wall, pivotal opening of the top serving to open the storage receptacle and the top of the slot.

9. A combination free standing desk and half wall structure according to claim 5, wherein the spacers are vertical beams, the spacers extending upwardly toward the top of the half wall but being recessed downwardly from the top of the half wall to permit electrical wires to pass over the spacers and under the top when the top is closed.

10. A combination free standing desk and half wall structure according to claim 9, wherein the desk and half wall structure us formed in discrete modules attached side-by-side, such that the half walls of each module are aligned, thus further enhancing the half-wall appearance, the spacers being positioned at each side edge of each section, the desk and half wall sections being attached together by removable fasteners that interconnect the spacers of adjacent sections.

11. A combination free standing desk and half wall structure according to claim 5 and further comprising accessory bracket means releasably mounted in the interior of the storage receptacle by bracket mounting means and extending therefrom outwardly through the longitudinal slot, the portion of the accessory bracket means extending out of the slot serving to support desk accessories off the surface of the desk.

12. A combination free standing desk and half wall structure according to claim 11, wherein the bracket mounting means comprises a terminal mounting strip attached to an inside surface of the outer panel and running longitudinally along the panel opposite the slot in the inner panel, the mounting strip having a contoured surface facing the slot the engages and mates with a coupling on an inner end of the bracket means, the bracket means being supported by engagement between the coupling and the mounting strip, the bracket means being slidable along the mounting strip so as to be supportable at different positions along the slot.

13. A combination free standing desk and half wall structure according to claim 12, wherein the mounting strip includes an inwardly and then downwardly extending flange that extends longitudinally along the mounting strip, and the coupling includes an outwardly and then upwardly extending hook that fits in the mounting strip behind the mounting strip flange, the flange holding the bracket means in position and restraining the bracket means from pivoting downwardly in the mounting strip when the bracket means is in a mounted position in the mounting strip.

14. A combination free standing desk and half wall structure according to claim 13, wherein the hook fits behind the flange and is disengagable from the mounting strip when the coupling is pivoted upwardly, the hook engaging the flange when the coupling is pivoted downwardly to the point where the bracket means is in its mounted position, the flange restraining the bracket means against pivoting downwardly past its mounted position.

15. A combination free standing desk and half wall structure according to claim 14, wherein a lower portion of the hook rests on an offset portion of the mounting strip when the bracket means is in its mounted position, the offset portion providing support against vertical and pivoted movement of the bracket means.

16. A combination free standing desk and half wall structure according to claim 15, wherein the coupling comprises a locking screw rotatably mounted in the coupling so as to be extendible into contact with the mounting strip at a position such that the force of the locking screw holds the brackets in its mounted position, the screw being retractable to dismount the bracket means from the mounting strip.

17. A combination free standing desk and half wall structure according to claim 11 wherein the accessory bracket means is at least partially supported by the lower edge of the slot in the inner panel.

18. A combination free standing desk and half wall structure according to claim 17 wherein this accessory bracket means is separated from the lower edge of the slot by a wear resistant pad mounted on the accessory bracket means.

19. An article of furniture as defined in claim 10, wherein said modules have at least one floor panel below said cover, said floor panel terminating in spaced relationship from at least one of said spacer beams to provide vertical continuity of the space within said half-wall structure.

* * * * *

UNITED STATES PATENT AND TRADEMARK OFFICE

CERTIFICATE OF CORRECTION

PATENT NO. : 4,948,205

DATED : August 14, 1990

INVENTOR(S) : James O. Kelley

It is certified that error appears in the above-identified patent and that said Letters Patent is hereby corrected as shown below:

Column 2, line 5 - insert --of-- after "installation";

line 10 - insert --shows-- after "9";

line 13 - insert --along-- after "incorporated";

Column 5, line 38,
Claim 10 - delete "us" and substitute --is--;

Column 6, line 2,
Claim 12 - delete second occurrence "the" and substitute
--that--;

line 39,
Claim 16 - delete "brackets" and substitute
--bracket--.

Signed and Sealed this

Thirty-first Day of December, 1991

*Attest:*

HARRY F. MANBECK, JR.

*Attesting Officer*

*Commissioner of Patents and Trademarks*